United States Patent [19]

Giacomelli et al.

[11] Patent Number: 4,782,987

[45] Date of Patent: Nov. 8, 1988

[54] METHOD FOR THE FEEDING OF A MATERIAL WEB

[75] Inventors: Peter Giacomelli, Husmansvägen; Anders Sundberg, Malmö, both of Sweden

[73] Assignee: Tetra Pak International AB, Lund, Sweden

[21] Appl. No.: 4,478

[22] Filed: Jan. 20, 1987

[30] Foreign Application Priority Data

Jan. 28, 1986 [SE] Sweden ..... 86003654

[51] Int. Cl.[4] ..... B65H 23/00; B65H 23/04

[52] U.S. Cl. ..... 226/2; 226/27

[58] Field of Search ..... 226/2, 27, 33; 355/28, 355/29, 50

[56] References Cited

U.S. PATENT DOCUMENTS

| | | | |
|---|---|---|---|
| 3,675,836 | 7/1972 | Young, Jr. et al. . | |
| 3,676,251 | 7/1972 | Young, Jr. et al. . | |
| 3,702,654 | 11/1972 | Young, Jr. . | |
| 3,707,420 | 12/1972 | Young, Jr. et al. . | |
| 3,790,424 | 2/1974 | Young, Jr. et al. . | |
| 4,176,944 | 12/1979 | Payrhammer | 226/33 X |
| 4,196,035 | 4/1980 | Reil . | |
| 4,422,357 | 12/1983 | Larsen . | |
| 4,453,823 | 6/1984 | Sugita et al. | 226/33 X |
| 4,519,868 | 5/1985 | Hoffmann | 226/27 X |

FOREIGN PATENT DOCUMENTS

| | | |
|---|---|---|
| 1381580 | 1/1975 | United Kingdom . |
| 1442678 | 7/1976 | United Kingdom . |

*Primary Examiner*—Stuart S. Levy
*Assistant Examiner*—Lynn M. Sohacki
*Attorney, Agent, or Firm*—Burns, Doane, Swecker & Mathis

[57] ABSTRACT

In the stepwise feeding of a packing material web for the application of cover strips over prepunched pouring openings, the pouring opening is sensed by means of a photocell which is located at as great a distance from the point of application as the distance between two pouring openings. Any errors in this distance will thus affect the accuracy of application. In order to avoid this is proposed in accordance with the invention to sense the passage of the actual pouring opening and start a countdown sequence, at the end of which the web feed is interrupted with the pouring opening in correct position for the application of the cover strip. An arrangement for the realization of this, seen in the direction of feed of the material web (1) comprises a sensing device (4), a processing device (5) and a forward feeding device (9) which are connected to a control unit (13).

2 Claims, 1 Drawing Sheet

METHOD FOR THE FEEDING OF A MATERIAL WEB

FIELD OF THE INVENTION

The present invention relates generally to web feeding devices and methods and, more particularly, to a method whereby in the stepwise feeding and processing of a material web provided with irregularities the web is stopped as an irregularity is in a predetermined position at a processing device. The invention also relates to an arrangement for the realization of the method.

BACKGROUND OF THE INVENTION

Packing containers of paper or plastic-coated paper are often manufactured from weblike-packing material which is provided with crease lines, emptying openings, tearing directions or print before it is divided into individual sheets or blanks and is converted by folding and sealing to finished packing containers. The majority of the working operations which are performed on the material web have to be carried out in register, that is to say, the working operation has to be done in a predetermined position on the material web in relation to the results of working operations already carried out previously. This is well-known in the technique of packaging and is achieved in a number of different ways.

When packing material webs are to be provided with cutouts, holes or the like which, for example, are to serve as pouring openings in the finished packing container, the pouring openings are punched out first at regular intervals in the weblike packing material. Thereafter some form of opening arrangement is applied which in its simplest form of realization may be constituted e.g. of a tear-off cover strip glued on over the prepunched pouring opening, so that the latter is closed in the desired manner. The application of the opening arrangements or cover strips hereby has to take place in register with the pouring openings.

The registry on application of the cover strips was achieved up to now in that the material web provided with pouring openings was made to pass a sensing device which was placed before the processing device at which the cover strips were applied. The distance between the point of application of the processing device and the sensing device corresponded to the distance between two pouring openings following each other in the packing material web or was equal to a multiple of that distance. By stopping the web each time a pouring opening is under the sensing device a cover strip can be applied over a pouring opening which previously has passed the sensing device, since it will then be right in front of the processing device. This arrangement functions well on the assumption that the distance between the emptying openings prepunched in the packing material web is correct. However, this is not always the case, and it may happen, moreover, in certain types of packing material that during the feeding the material stretches a little, which has the result that the cover strips will be placed slightly out of register with the emptying openings, that is to say they will go somewhat awry, and, under adverse circumstances, may end up partly outside the emptying openings.

It is desirable, therefore, to provide a method and an arrangement which make it possible to process a material web furnished with irregularities in complete register with the said irregularities, regardless of whether the irregularities vary slightly or whether the web tends to be lengthened or shortened during the handling.

OBJECTS AND SUMMARY OF THE INVENTION

It is an object of the present invention to provide an accurate method which makes it possible to process a material web in register with irregularities furnished previously and which is not subject to the disadvantages of the abovementioned known methods.

It is a further object of the present invention to provide a method of the said type, this method being simple, reliable and adaptable to different types of processing and material webs.

These and other objects have been achieved in accordance with the invention in that a method of the type referred to in the introduction has ben given the characteristic that the passage of the actual irregularity is sensed at a predetermined distance before the processing device, this sensing starting a countdown sequence at the end of which the feed is interrupted.

A preferred embodiment of the method in accordance with the invention has been given, moreover, the characteristics which are evident from the claims.

It is also an object of the present invention to provide an arrangement for the realization of the method, this arrangement being of rapid and safe function and not being subject to the disadvantages of previously known arrangements.

It is a further object of the present invention to provide an arrangement of the said type, this arrangement being inexpensive, space-saving and well suited to be used jointly with high-capacity packing machines of the type which convert a material web to individual packing containers.

These and other objects have been achieved in accordance with the invention in that an arrangement of the type referred to in the introduction has been given the characteristic that, seen in the feed direction of the web, it comprises a sensing device, a processing device and a feeding device which is constituted of a driven feed cylinder, provided with pulse generator, which like the sensing device is connected to a control unit and is adapted to interrupt the feeding a set number of pulses after a starting signal from the sensing device.

Preferred embodiments of the arrangement in accordance with the invention have been given, moreover, the characteristics which are evident from the claims.

By sensing in accordance with the invention the position of precisely that hole which is to be processed, and subsequently stopping the web an accurately specified number of pulses after the sensing, the processing can take place with very small margin in register with the actual irregularity of the web. Through the method of sensing precisely that irregularity which is to be processed, any altered or faulty distances between the irregularities, extensions in the web or other similar faults will not affect the final result. Consequently an almost exact application can be carried out of e.g. cover strips over pouring openings which are placed irregularly in longitudinal direction of the material web.

A preferred embodiment of the method as well as of the arrangement in accordance with the invention will now be described in more detail with special reference to the attached schematic drawing which only shows the details indispensable for an understanding of the invention and in which:

FIG. 1 is a perspective view of an arrangement in accordance with the invention as it may be designed when it is used for application of opening arrangements to a packing material web provided with pouring openings; and FIG. 2 is a schematic view useful in describing the method in accordance with the invention.

DETAILED DESCRIPTION OF A PREFERRED EMBODIMENT

Figure 1:
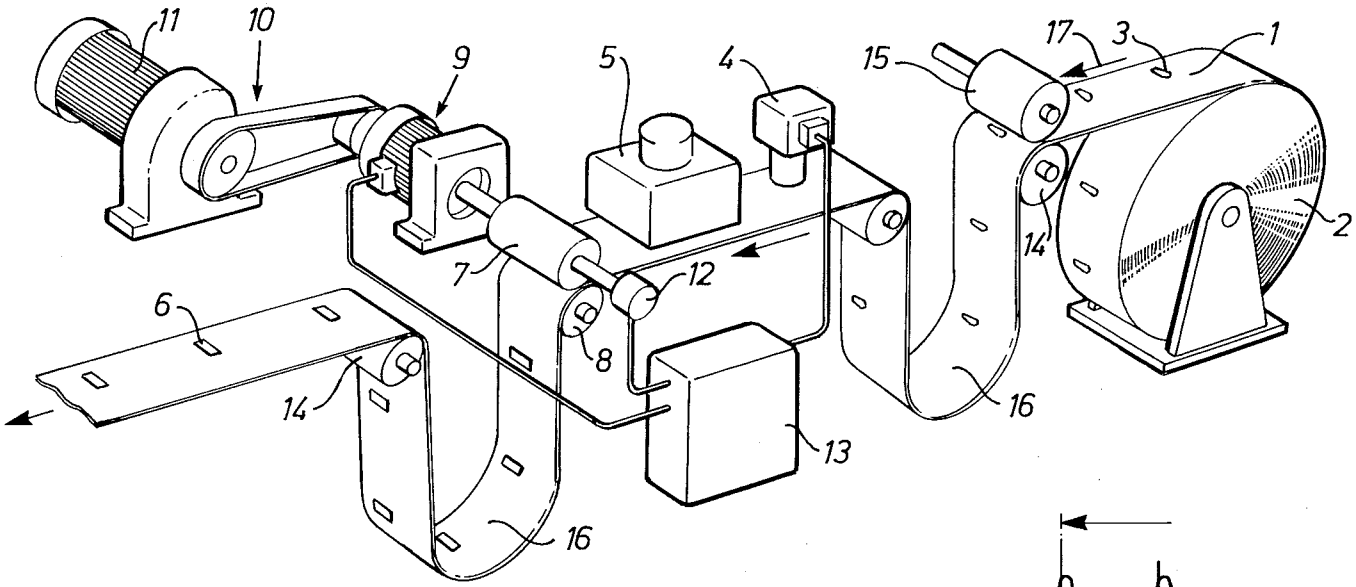

The arrangement in accordance with the invention is intended for the stepwise feeding of a material web 1 which is rolled off a material roll 2 supported so that it can freely rotate. The material web 1 is furnished with a number of irregularities 3 in the form of punched-out pouring openings which are provided at substantially equal distances along the length of the material web. The term "irregularities" is used in the description and claims to designate any form of marking (e.g. holes, slots, cutouts, indentations or printed markings) which diverge in registrable manner from the rest of the material web.

The arrangement in accordance with the invention comprises, moreover, a sensing device 4 which is placed in such a position adjoining the material web 1 that the irregularities 3 or pouring openings pass directly under the sensing device 4. The sensing device may be constituted, for example, of a photocell which is directed towards the web and records the transition from the material web to the pouring opening. In cases where, in laminated packing material, the pouring opening extends only through certain layers of the material (e.g. through a central carrier layer but not through plastic or aluminium foil layers), the sensing device records the transition from one material type to another.

Immediately after the sensing device 4 is located a processing device 5 which is placed adjoining the path of movement of the material web 1 and comprises a unit adapted to apply opening arrangements 6 in the form of cover strips onto the material web in register with the pouring openings. Arrangements for the application of different types of opening arrangements or cover strips to material webs are well-known to the expert and are not described in greater detail therefore in this context.

At some distance after the sensing device 4 and the processing device 5, seen in the direction of movement of the material web is located a feed cylinder 7 which, together with a counter-cylinder 8 located underneath the material web, engages the material web and drives the same forward in the direction from right to left in FIG. 1 The feed cylinder 7 is connected via a driving shaft with a forward driving device 9 which is stepwise rotatable and lockable in a desired position. The forward driving device 9 is actuated via a power transmission 10 by means of a conventional electric motor 11. On the driving shaft of the feed cylinder 7 is located a pulse generator 12 which like the forward driving device 9 and the sensing device 4 is connected electrically to a control unit 13.

The arrangement in accordance with the invention comprises a number of guide rollers 14 which, together with guide rails and other guide elements, not shown, guide the packing material web through the unit. Furthermore, a driving cylinder 15 is present for the unrolling of the material web 1 off the material roll 2 timed so, that the intermittent driving forward of the material web through the arrangement in accordance with the invention with the help of the feed cylinder 7 is not affected by the inertia of the material roll 2. The part of the material web which is being processed by the arrangement in accordance with the invention is isolated from remaining parts of the material web by means of two material loops 16, the length of which is sensed mechanically or by means of photocells not shown and controls the feed of material web before and after the isolated part of the web. This too is conventional and well-known to those versed in the art and, therefore, will not be described in more detail.

As is evident from FIG. 1 the sensing device 4 is located a little distance in front of the processing device 5, seen in the direction of movement of the material web 17. More particularly, the distance between the photocell of the sensing device 4 and the strip application position of the processing device 5 is smaller than the distance between two consecutive irregularities 3 of pouring openings in the material web 1.

Figure 2:
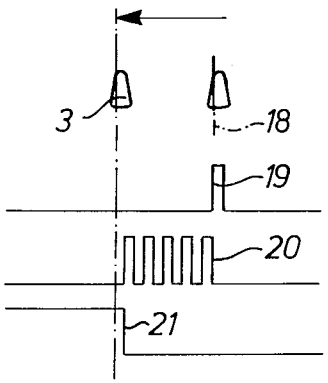

When the arrangement according to the invention is used in accordance with the method of the invention to apply opening arrangements 6 in the form of tear-off cover strips in register over the pouring openings in the packing material web 1, the latter is unrolled off the material roll 2 with the help of the driving cylinder 15 and the guide roller 14 co-operating with the same. The driving of the cylinder 15 is controlled in conventional manner depending on the length of the material loop 16 located adjoining the driving cylinder 15 which is read by means of photocells, not shown. The feed of the material web 1 from the said loop 16 and past the arrangement in accordance with the invention is done by means of the feed cylinder 7 which advances the material in steps. More particularly, the feed cylinder 7 drives the packing material web 1 from right to left in FIG. 2 until the sensing device 4 with its photocell senses the presence of a pouring opening in the material web and signals this to the control unit 13. The photocell of the sensing device 4 senses the difference in light on transition from the packing material to the pouring opening, and thus indicates the front edge of the pouring opening, seen in the direction of feed of the material web 1, as shown by reference designation 18 in FIG. 2. The pulse 19 produced starts a pulse counter in the control unit 13 which commences to count the pulses 20 arriving continuously from the pulse generator 12 on rotation of the feed cylinder 7. After a predetermined number of pulses, which is the equivalent of a feed length corresponding to the distance between the sensing device 4 and the processing device 5, the control unit 13 transmits a signal 21 to the forward driving device 9, which directly interrupts the rotation of the feed cylinder 7 and locks the same in its rotational position. The pouring opening sensed is now directly under the point of strip application of the processing device 5, and the cover strip can be applied in correct position over the current pouring opening. As soon as the application has been completed the feed cylinder 7 is restarted and the procedure is repeated.

In the process described above the photocell has been used for sensing the front edge or boundary line of the pouring opening, seen in the direction of feed, that is to say the photocell has registered the change in luminous intensity on transition from the packing material to the pouring opening. This gives a satisfactory result in the case where the edge of the pouring opening is rectilinear and located at right angles to the web edge, that is to say the direction of feed of the material. However, if the pouring opening is round or oval or has straight edges which are not perpendicular to the longitudinal direction of the web, the lateral position of the web will be of significance for the result of the sensing.

Through a slight modification of the method and of the arrangement in accordance with the invention it is possible, however, to ensure good precision also in such cases, provided only that the irregularity or the irregularly shaped pouring opening has a line of symmetry at right angles to the web edge, which in practice will be the case most frequently in pouring openings. In this realization of the method and of the arrangement in accordance with the invention the photocell reads not only the position of the front edge of the pouring opening, but also of its rear edge (seen in the direction of feed of the web). The width of the hole may be registered thereby as a number of pulses, and half this number indicates the distance from each edge to the line of symmetry of the pouring opening. Thus the line of symmetry may be used to indicate with great reliability and precision the position of the pouring opening irrespectively of the shape of the pouring opening and the lateral position of the web.

In practice this embodiment of the method in accordance with the invention is carried out simplest in that the pulse counter in the control unit 13 is started when the sensing device 4 records the front edge, seen in the direction of feed of the web, of the pouring opening 3 (or of any other irregularity). Up to the moment when the second edge too has been recorded the pulse counter counts only every other pulse, however, proceeding subsequently to count each pulse until a predetermined number of pulses has been counted and the control unit interrupts the web feed. Through counting only every other pulse, the half lengths of the irregularity is recorded and this corresponds in practice, therefore, to a countdown start at the line of symmetry of the pouring opening, which makes it possible after a predetermined number of pulses to interrupt the web feed in the correct position, irrespectively of any irregular shape of the pouring opening or the lateral position of the packing material web at the instant of sensing.

To ensure that any faulty photocell recordings do not affect the final result, a further modified embodiment of the method in accordance with the invention can be used. Here two counters are used, both of which are started by the front edge of the pouring opening. The first counter counts only every other pulse from the pulse generator and is not affected by any further signals from the photocell. At each subsequent signal from the photocell the value of the first counter is stored in a register and the second counter is set to zero, but is started immediately afterwards. After the last photocell signal the register of the first counter will indicate the width of half the pouring opening expressed in pulses and the register of the second counter indicates the distance from the rear edge of the pouring edge seen in the direction of feed. When the first counter has reached a value which is known to imply that the whole pouring opening has passed with certainty, the value in the register of the first counter is added to the predetermined value which indicates where the web feed should be interrupted. When the second counter has recorded a number of pulses which is equal to this value, the feed is interrupted.

The abovementioned method may also be realized in such a manner that the counter is set from the start to the desired number of pulses in the countdown sequence, that is to say the number of pulses from, the front edge of the pouring opening to the stopping position of the web. Subsequently both counters are started at the front edge of the pouring opening and subtract pulses from the set value, the first counter, as before, only giving up every other pulse. At each further signal from the photocell the value is moved in the first counter. After the last possible photocell signal, that is to say at the rear edge of the pouring opening, the value of the second counter has been reduced by a number of pulses which corresponds to half the width of the pouring opening, and when the counter has counted down to zero, the stopping position of the web has been reached.

The methods with two counters described above are particularly suitable in those cases where the contrast between the pouring opening and the surrounding packing material is so slight that there is a risk of wrong signals from the photocell when the pouring opening passes. Only when the last photocell signal (which thus must originate from the rear edge of the pouring opening) has been recorded with certainty, the pulses received are utilized to indicate together with a predetermined pulse number where the web feed is to be interrupted, and this method consequently gives a completely reliable result even under difficult circumstances. A greater technical effort with several counters and further electronics is required in this case though, so that this method ought to be used only where the danger of errors otherwise becomes unacceptably great.

The distance between the signal 19 of the sensing device 4 and the feed stop 21 may be varied by setting a desired number of pulses 20 on the pulse counter of the control unit 13. Consequently the fine adjustment of the position of application can be done electrically and any need for adjusting the physical position of the sensing device 4 does not arise, therefore, which improves the precision and endurance of the arrangement. Owing to the sensing taking place at precisely the pouring opening which is to be covered with a cover strip, the accuracy is increased very appreciably compared with previously known arrangements which means on the one hand that the risk of wrong applications is avoided, on the other hand that tolerances can be smaller than previously so that the size of the cover strip can be reduced and less material will be consumed. Owing to the principle of sensing the actual pouring opening which is to be covered, any resettings on making changes between material webs with different nominal distance between pouring openings are also avoided. The method and the arrangement in accordance with the invention, which may be used, of course, in any type of processing which is to be carried out in register with irregularities furnished previously on a material web, have proved to function well in practical tests also in very high-capacity packing machines and during lengthy operation.

While this invention has been illustrated and described in accordance with a preferred embodiment, it is recognized that variations and changes may be made and equivalents employed herein without departing from the invention as set forth in the claims.

What is claimed is:

1. In the stepwise feeding and processing of a material web, a method of stopping the web when a center line of an irregularity on the web is in a predetermined position at a processing device including the steps of:

presetting first and second counters to a predetermined value representative of a distance between a front edge of an irregularity on the web and the predetermined position at the processing device, generating pulses upon the movement of the material web a fixed distance in the direction of travel of the web, sensing the passage of the front edge of the irregularity at a predetermined distance in front of the processing device, initiating counting down of pulses received by the first and second counters upon the sensing of the front edge of the irregularity, sensing the passage of the rear edge of the irregularity at the predetermined distance in front of the processing device, changing the value in the second counter by a number of pulses corresponding to one half the width of the irregularity such that the value in the second counter after the sensing of the rear edge of the irregularity is reduced from the preset value by an amount corresponding to one half the width of the irregularity, counting down the remaining value in the counter, and stopping the web when the value in the counter equals zero so that the center of the irregularity is positioned at the predetermined position.

2. The method in accordance with claim 1, including the step of regulating said preset predetermined value.

* * * * *